US006141609A

United States Patent [19]

Herdeg et al.

[11] Patent Number: 6,141,609

[45] Date of Patent: Oct. 31, 2000

[54] DEVICE FOR RECORDING INFORMATION ON A VEHICLE'S ITINERARY

[75] Inventors: Wolfgang Herdeg, Ellwangen; Andreas Widl, München, both of Germany

[73] Assignee: Mannesmann Aktiengesellschaft, Düsseldorf, Germany

[21] Appl. No.: 08/640,931

[22] PCT Filed: Nov. 4, 1994

[86] PCT No.: PCT/DE94/01342

§ 371 Date: May 8, 1996

§ 102(e) Date: May 8, 1996

[87] PCT Pub. No.: WO95/13594

PCT Pub. Date: May 18, 1995

[30] Foreign Application Priority Data

Nov. 8, 1993 [DE] Germany ..... 43 38 556

[51] Int. Cl.[7] ..... G07C 5/08

[52] U.S. Cl. ..... 701/35; 701/207; 340/995

[58] Field of Search ..... 701/35, 29, 123, 701/207, 208, 213, 210, 214; 342/357, 457; 340/438, 441, 459, 460, 992, 993, 825.31, 825.32, 825.34, 990, 995

[56] References Cited

U.S. PATENT DOCUMENTS

| | | | |
|---|---|---|---|
| 4,072,850 | 2/1978 | McGlynn | 701/35 |
| 4,591,823 | 5/1986 | Horvat | 340/53 |
| 4,853,859 | 8/1989 | Morita et al. | 340/459 |
| 4,866,616 | 9/1989 | Takeuchi et al. | 340/459 |
| 4,897,792 | 1/1990 | Hosoi | 701/208 |
| 4,926,331 | 5/1990 | Windle et al. | 701/35 |
| 4,939,652 | 7/1990 | Steiner | 340/438 |
| 5,014,206 | 5/1991 | Scribner et al. | 701/207 |
| 5,249,127 | 9/1993 | Komatsu | 364/550 |
| 5,353,023 | 10/1994 | Mitsugi | 340/989 |
| 5,359,528 | 10/1994 | Haendel et al. | 701/35 |
| 5,434,787 | 7/1995 | Okamoto et al. | 701/214 |
| 5,541,858 | 7/1996 | Warner | 364/561 |
| 5,550,738 | 8/1996 | Bailey et al. | 761/35 |
| 5,557,524 | 9/1996 | Maki | 340/995 |
| 5,581,464 | 12/1996 | Woll et al. . | |
| 5,581,630 | 12/1996 | Bonneau, Jr. | 340/825.34 |

FOREIGN PATENT DOCUMENTS

| | | |
|---|---|---|
| 189204 | 7/1986 | European Pat. Off. . |
| 91413 | 8/1986 | European Pat. Off. . |
| 0508405 | 10/1992 | European Pat. Off. . |
| 592166 | 4/1994 | European Pat. Off. . |
| 2612319 | 9/1988 | France . |
| 33 38 113 | 5/1985 | Germany . |
| 38 28 725 | 4/1989 | Germany . |
| 38 39 221 | 2/1990 | Germany . |
| 41 14 779 | 11/1991 | Germany . |
| 4220963 | 1/1993 | Germany . |

OTHER PUBLICATIONS

Article from Elektronik Informationen Nr. 10–1992 entitled "Chips für Smartcard–Anwedungen" by Antony Watts, SGS–Thomson, Agrate, 3 pp.

P. 81 of "Elektronik Informationen Nr. 10–1992".

Sabounghi, "Intelligent Vehicle Highway System—The Universal Close–Range Road/Vehicle Communication System Concept—The Enhanced AVI and Itso CVO Application", IEEE, pp. 957–967, Oct. 1991.

*Primary Examiner*—Tan Nguyen

*Attorney, Agent, or Firm*—Cohen, Pontani, Lieberman & Pavane

[57] ABSTRACT

A device installed in a vehicle for recording information on the itinerary of the vehicle. The device includes a receiver system for receiving wirelessly transmitted information for identifying the current geographical position of the vehicle, a computer unit for computing digitalized data on the geographical position of the vehicle, and a memory unit for continuous storage of the digitalized geographical position data of the vehicle on a data carrier, which is protected against overwriting of recorded data, whereby the memory device also stores time data, which allow identification of the particular point in time at which a particular vehicle position was found. So that an itinerary taken by a vehicle can later be reconstructed without great expense the data carrier is configured to be easily exchangeable, and a data reading device is provided for the input of data that identify the driver of the vehicle and are recorded on the data carrier.

19 Claims, 1 Drawing Sheet

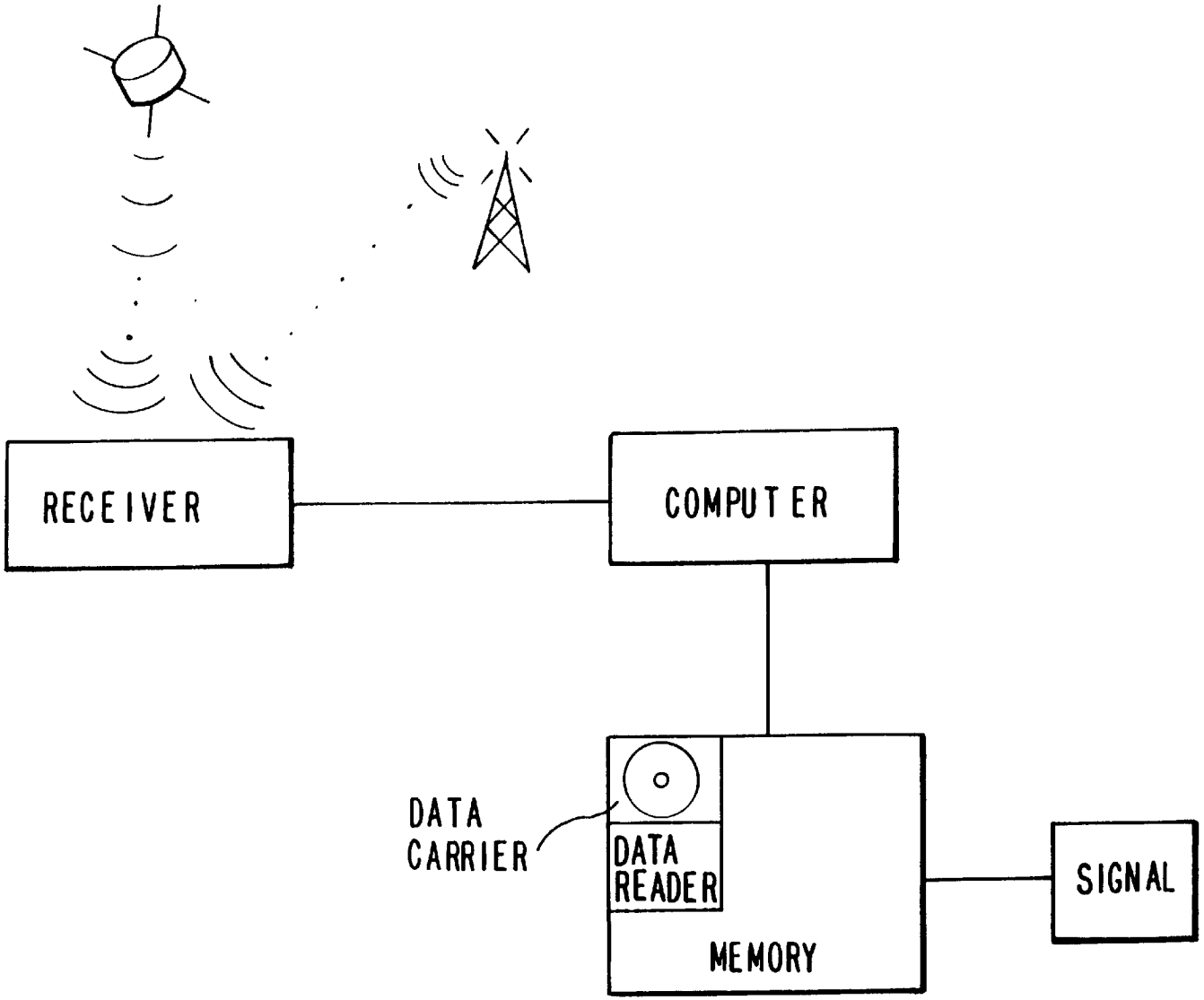
RECEIVER
COMPUTER
DATA CARRIER
DATA READER
MEMORY
SIGNAL

DEVICE FOR RECORDING INFORMATION ON A VEHICLE'S ITINERARY

BACKGROUND OF THE INVENTION

The invention relates to a device installed in a vehicle for recording information on the vehicle's itinerary.

In the unpublished patent application DE-P 43 10 099.6 of the applicant, a device for a utilization calculation system is proposed that is especially suited for calculating the charges for a road network that requires the payment of fees (e.g., calculating Autobahn tolls), This device is distinguished from other known calculation systems primarily by the fact that the charges are calculated practically exclusively within the vehicle itself and that no information about the toll roads taken by the vehicle leaves the vehicle. This is possible because each vehicle carries a calculation device that continually deducts the proper charge, based on the applicable tariff for the section of road just taken, from a credit balance, which is maintained on a mobile credit balance memory device (e.g., a chip card) and which has been purchased in advance by the driver at any desired payment point (e.g., an automatic chip card dispenser). For this purpose, tariff information is available from a memory unit of the device. In order to supply the calculation device with the information needed to identify the section of toll road just used, the device has a receiver system, with which information can be received from a satellite navigation system or a radio direction finding system, for example, which indicates the current geographical position of the vehicle or allows this position to be determined with the help of a computer unit of the device. Furthermore, the calculation device has a memory unit, in which geographical information concerning so-called "identification points" is stored, which allows the unambiguous identification of the individual toll segments of the road network. Via the receiver system, data are determined at short, regular intervals (e.g., every second) for the current geographical vehicle position at that moment with high accuracy (e.g., 100 m). If the determined position data are sufficiently close to consecutive identification points, it is possible to conclude from them that the associated toll road section has been traversed, and an appropriate deduction can automatically be made from the positive credit balance on the chip card. Although this device determines the geographical positions passed by the vehicle in a very accurate manner, the device is not meant or designed to store this type of position data permanently.

In FR 26 12 319, a device installed in a vehicle is described that makes it possible to also record, along with vehicle-specific data (e.g., motor speed, fuel consumption), data that identify the route, on an exchangeable data carrier designed, for example, as a chip card, for the purpose of cost computation taking into account the intensity of the utilization of a vehicle. In this connection, only the possibility of recording the route travelled is mentioned. However, no suggestions are given for collecting and storing in a manner protected against overwriting data that allow a reliable statement to be made concerning the location at which the vehicle was located during a trip at a particular given time.

Data can already be stored on the exchangeable data memory device that identify the driver, so that these data can be entered by means of a data reading device. In addition, it is possible for the purposes of checking to enter additional data identifying the driver via a keyboard attached to the device, in order to prevent misuse of the data carrier by an unauthorized person. After calculation has been carried out, the recorded data can again be written over with the data of the next trip.

EP-A 0 508 405 describes a system for determining the position of a vehicle, which preferably is based on the use of a system for satellite navigation. In order to be able to record the daily travel performance of a commercial vehicle (e.g., a taxi) as accurately as possible and with the lowest possible device-related expense, this system calls for a simple device in each vehicle, which permits the reception of satellite signals and the storage of these data with associated time information in digital form on a chip card. For regular analysis, the recorded data can be read out from the chip card into a vehicle-external computer, which determines via an analysis program the vehicle position data computable from the satellite signals as well as the routes resulting therefrom and in this way determines the vehicle performance. Data recording protected against overwriting is not considered, nor is the recording of data that permit unambiguous identification of the driver.

EP-A 0 189 204 relates to a vehicle-internal device intended for a utility vehicle for recording essential operating parameters of vehicle use on a mobile storage medium, e.g., a chip card. This storage medium can be read into an external computer device, so that the recorded data are available for analysis for purposes of administration (e.g., cost calculation) or vehicle maintenance. Recording data protected against overwriting for unambiguous identification of the driver of the vehicle and of locations at which the vehicle was located at given points in time is not considered.

In EP-A 0 191 413, a trip recorder is proposed in which, analogous to the usual tachographic registration, routes taken and speeds are recorded on an electronic storage medium, which is designed as a mobile data card and into which data identifying the driver are entered. The collection of geographical positions of the vehicle is not foreseen. A printer unit integrated into the trip recorder allows the printing out of a tabular trip protocol with the work time data and route data of the driver.

From U.S. Pat. No. 5,016,206, an electronic recording device for garbage collection vehicles is known, with which the particular location of the garbage collection vehicle as well as associated time information are stored when the garbage collection vehicle carries out a procedure for loading or unloading garbage. In order to determine the location, the vehicle is equipped with a device for receiving signals of a navigational transmitter (e.g., navigational satellite system). A write-protected recording of data that unambiguously identifies the driver, as well as of data that permits an exact identification of vehicle position at any given point in time for the purposes of traffic control, is not provided.

From DE 38 28 725 A1, a device for recording information on a vehicle's itinerary is known that is used as a navigational device for motor vehicles. For the purpose of determining current location, this device has a receiver system for the satellite navigation system (GPS). In addition, the device has a memory with digitalized maps and a data carrier—for example, in the form of a chip card (IC card)—for storing itinerary data. A computer unit determines the data of the route actually taken by the vehicle and stores this data on the data carrier; information about the travel time consumed can also be stored. In order to minimize the quantity of stored data, the device stores the identifying index numbers of individual maps (map numbers) and the routes contained therein (route numbers) as well as the so-called "junctions" (e.g., route branchings) only after these points have actually been passed by the vehicle. No information is recorded as long as the current values of map numbers and route numbers remain unchanged.

This known device serves only as a navigational aid for the vehicle driver and is meant to supply the driver with better and more informative data (e.g., in respect to the travel time remaining until destination) when he takes the same route again. This device is not intended for legal traffic monitoring tasks. No disclosures are made as to whether the data carrier for recording information on the vehicle's itinerary might perhaps not be installed permanently into the device, unlike the other components, but is rather arranged in easily exchangeable fashion.

Especially in the case of commercial transports, there is often the desire to collect information on the itinerary of a vehicle not only quantitatively (length) but also qualitatively (routing), in the form of a trip journal, and also to determine without any doubt who drove the vehicle. For example, for special transports of hazardous materials (e.g., the transport of radioactive material) very definite travel routes can be designated, from which no deviations are permitted. It is presently very expensive to provide proof of this, because doing so requires the use of appropriate monitoring personnel in each vehicle or even the use of escort vehicles.

On the other hand, there are geographical zones (e.g., protected drinking water areas) where vehicles with loads that are potentially hazardous to water (e.g., tanker trucks) are generally not permitted to travel. Until now, violations of such regulations could be detected only if noticed (by chance) by monitoring personnel working on the spot.

Furthermore, it should be noted that it is the operators of larger vehicle fleets (e.g., shipping companies) in particular who have an interest in directing and monitoring the economic utilization of their transport capacities (fleet management systems) as well as possible. Until now, in respect to the actual operation of vehicles, only the data provided by legally-required trip recorders for utility vehicles is available, which is recorded on tachograph charts. These do not permit the later reconstruction of the individual roads actually taken by the vehicle.

SUMMARY OF THE INVENTION

The object of the present invention is to further develop a device of the generic type in such a way that the routes taken by a vehicle can later be reconstructed without great expense and unambiguous information can be secured that also makes it possible to prove conclusively who drove the vehicle at what time and where.

Pursuant to this object, and others which will become apparent hereafter, one aspect of the present invention resides in a device for recording itinerary data of a vehicle, which device includes a receiver system for receiving wirelessly transmitted data for identification of a current geographical position of the vehicle. Computer means are provided for computing digitalized the data of the geographical vehicle position. Memory means continuously store the digitalized geographical vehicle position on a data carrier which is exchangeably mounted to the memory means and is protected against overwriting of the recorded data. The memory means initially also stores time data for identifying a particular point in time at which an individual geographical vehicle position is determined. Additionally, a data reading device is provided for inputting data which identify the vehicle operator and are recorded on the data carrier.

This object is attained by means of the characterizing features of Patent claim 1. Advantageous further developments of the invention are indicated in the subclaims 2 to 13.

By means of the present invention, an "electronic trip journal" is automatically maintained, into which all trips of a vehicle are entered in a manner that permits its route to later be reconstructed. For this purpose, a device is carried in the vehicle, which is installed in the vehicle as a compact device or as separate components connected to one another by means of informational technology. An essential part of the invention is a receiver system, with which wirelessly transmitted data can be received that allow the geographical position just reached by the vehicle to be accurately determined (e.g., on the basis of signals of a satellite navigation system such as GPS or GLONASS) or itself shows positional data (e.g., with a radio direction finding system). Accurate location determination can also be carried out in the framework of a mobile cellular broadcast network. The use of a satellite navigational system is considered especially preferable. In this case, the device according to the invention is also equipped with a computer unit that permits computation of the relevant positional data based on the received satellite information. A further essential component is a memory device, which allows the digitalized geographical vehicle position data to be recorded on a data carrier. The data carrier is easily exchangeable and is protected against overwriting of already recorded data, in order to prevent impermissible later manipulations of stored data. To this end, encryption of the recorded data is also possible, and can advantageously be connected to compression of the recorded data. Compression offers the additional advantage of substantially increasing the capacity of the data carrier. A memory device with a magnetic basis, such as a diskette, can be used as the data carrier, for example. Optical memory media (compact disks) are especially suitable; those with only one-time writability (WORM) are preferred.

Along with purely geographical position data, the memory device also records associated time information (time of day, date). Advantageously, the position data are determined by the device at regular time intervals (e.g., every 5 to 10 seconds). A possible alternative is route-dependent position finding (e.g., every 100 m). Especially in the first case, which calls for fixed clock timing, it is naturally not necessary to store a time datum for each position datum. For example, it would be possible, based on the recording of the start time of a trip, to calculate the respective associated times for the individual position data based on the clock. The time information itself can be obtained by means of a clock integrated into the device according to the invention or by means of an appropriate transmission system from outside.

In addition, the device according to the invention is also equipped with a data reading device, which makes it possible to enter data that identify the driver of the vehicle. These data are also recorded on the data carrier that stores the route information in memory. In particular, a chip card reader can be used for such a data reading device. In order to prevent possible misuse, additional identification, for example, a personal identification number (PIN), can be entered by means of a keyboard or via fingerprint reader or a voice identification device.

When the fingerprint or the voice of the driver is checked, a chip card can naturally be dispensed with, if the identifying data have previously been stored one time in a suitable data storage device of the device according to the invention.

In an advantageous further embodiment of the invention, the device can be equipped with an interface, via which current data on vehicle operation can be provided for recording in the storage device. The additional recorded data can relate, for example, to vehicle speed, current fuel consumption, motor speed or similar variables. In this way, it becomes possible to carry out evaluations on which, for example, better economic utilization of transportation resources can be achieved. A further interface can be provided, via which the recorded data or the data to be recorded (especially the position data) are transmitted continuously or at certain time intervals (e.g., every 5 minutes) by means of a communications device carried in the vehicle, preferably a mobile phone as per the GSM standard, to a receiver point (e.g., the dispatch center of a shipping company) for analysis. This makes it possible to exercise, for example, deliberate external influence on the vehicle route to be chosen. For purposes of police checking, the data carrier can be removed (like the tachograph chart of a trip recorder) from the device according to the invention and checked in a suitable reading device. For this purpose, the reading device has a digitalized street map, so that the route of travel can be accurately simulated by comparing the recorded position data to the stored data of the street network. Instead of removing the data carrier, however, a suitable interface can be provided which allows the stored data to be read out.

In order to notify the driver in time to exchange an almost depleted data carrier (i.e., one that is almost filled up) for a data carrier with sufficient free memory capacity, so that a loss of data is avoided, the device according to the invention should be provided with a suitable signal device that is controlled by software and warns the driver when the capacity limit will soon to be reached.

BRIEF DESCRIPTION OF THE DRAWING

The single FIGURE is a schematic representation of the inventive device.

DETAILED DESCRIPTION OF THE PREFERRED EMBODIMENTS

The invention will be described in greater detail by means of the following example:

In the vehicle of a shipping company, there is a device according to the invention for recording information on the vehicle itinerary. At intervals of 5 seconds, this device calculates the geographical position of the vehicle via the GPS satellite navigational system. The digitalized position coordinates, together with the particular point in time at which the position information was obtained, are stored on a mobile data carrier in the form of a CD-WORM. In addition to this information, the vehicle speed and the actual fuel consumption are collected via an interface and are also stored. In order to relate the recorded data to the driver of the vehicle, the device is informed of the driver's identify prior to the start of the trip via a chip card reader, which reads the data on a chip card belonging to the driver in question. The data carrier for recording the route information is easily exchangeable and has a large memory volume. Because the itinerary is usually known before a trip starts, the memory required can be estimated in a timely manner and a suitable data carrier with sufficient free capacity can be used, so that the entire trip is documented. In the event that memory problems nonetheless occur, a warning can be generated in a timely manner by a suitable software routine, telling the driver to remove the almost full data carrier and replace it with an empty one.

After the end of the trip, the stored data can be placed in an archive and compared as necessary to a digitalized road map. This comparison can be processed graphically by suitable software and archived in the form of hard copy.

In a further development of the invention, the collected data (in addition to be stored) can be sent via an additional interface with a mobile phone as per the GSM standard to the central operations office of the shipping company. There these data are made available for analysis so that the course of the trip can be influenced as needed. For example, such an interface could be used to direct a hazardous materials transport along a route based on the current traffic situation. The GPS and GSM functions are advantageously combined in one device. In order to prevent the identity of a driver from being falsified to his disadvantage, because he is liable under certain circumstances for damages that arise during the trip, the driver to whom the chip card belongs must prove his identity prior to beginning the trip by entering a PIN code via a keyboard. This prevents an unauthorized person from driving with a chip card that is not rightfully in his possession. So that the recorded data cannot be manipulated, they are stored in encrypted form. At the same time, to reduce the data volume, suitable data compression is used. From the start, the data carrier is writable only once (WORM), so that later manipulations are ruled out. Manipulation at the interface with the position data collection system or the other interfaces is prevented by suitable sealing measures. In order to allow the vehicle to be checked by the police during a trip, an additional interface is provided on the device, which makes it possible to rapidly read out the data on the trip history.

In the navigational device known from DE 38 28 725 A1, the itinerary data are, because of the system used, recorded only for very particular points on a route. This means that deviations from a pre-established route of travel, for example, temporary travel on dirt roads, which are not included on the digitalized road map, can go undetected, as can impermissible lingering at any given point between two (fly established) recording points. The device according to the invention closes these loopholes completely.

What is claimed is:

1. A device for recording itinerary data of a vehicle, the device comprising:

a receiver system for receiving wirelessly transmitted data for identification of a current geographical position of the vehicle;

computer means for computing digitalized data of the geographical vehicle position;

memory means for continuously storing the digitalized geographical vehicle position data on a data carrier, which is protected against overwriting of recorded data, the memory means additionally storing time data for identifying a particular point in time at which an individual geographical vehicle position is determined, the data carrier being exchangeably mounted in the memory means;

data reading means for inputting data which identify a vehicle operator and are recorded on the data carrier; and additional input means for inputting data identifying the operator.

2. A device as defined in claim 1, wherein the memory means is operative to record the data on the data carrier in encrypted form.

3. A device as defined in claim 1, wherein the data reading means is a chip card reader.

4. A device as defined in claim 1, wherein the additional input means includes a keyboard.

5. A device as defined in claim 1, wherein the additional input means includes a fingerprint recognition device.

6. A device as defined in claim 1, wherein the additional input means includes a voice identification device.

7. A device as defined in claim 1, wherein the memory means is a diskette station.

8. A device as defined in claim 1, wherein the memory means includes an optical memory medium.

9. A device as defined in claim 8, wherein the optical memory medium is a compact disk with one-time writability.

10. A device as defined in claim 1, wherein the memory means includes an innerface via which current data on vehicle operation can be collected and recorded.

11. A device as defined in claim 10, wherein the innerface is configured so that at least one of vehicle speed, fuel consumption and engine speed can be collected and recorded.

12. A device as defined in claim 1, wherein the memory means is operative to record the digitalized data on the data carrier in compressed form.

13. A device as defined in claim 1, and further comprising signal means for giving a warning signal in a timely manner when a capacity limit of the data carrier approaches.

14. A device as defined in claim 1, wherein the memory means includes an innerface via which at least a portion of the recorded data can be read out for verification purposes.

15. A device as defined in claim 1, and further comprising communication means for transmitting the data to a receiver point for analysis.

16. A device as defined in claim 15, wherein the communication means includes a mobile telephone operative on the GSM standard.

17. A device as defined in claim 1, wherein the receiver system is configured to receive data from a satellite navigation system.

18. A device as defined in claim 1, wherein the receiver system is configured to receive data from a radio direction finding system.

19. A process for recording itinerary data of a vehicle, comprising the steps of:

receiving wirelessly transmitted data for identifying a current geographical position of the vehicle;

computing digitalized data of the geographical vehicle position;

continuously storing the digitalized geographical vehicle position data on an exchangeable data carrier which is protected against overwriting of recorded data, additionally storing time data for identifying a particular point in time in which an individual geographical vehicle position is determined;

inputting data which identify a vehicle operator and are recorded on the data carrier; and inputting additional data identifying the operator and not recorded on the data carrier.

* * * * *